US006160361A

United States Patent [19]

Giannopoulos et al.

[11] Patent Number: 6,160,361

[45] Date of Patent: Dec. 12, 2000

[54] FOR IMPROVEMENTS IN A LAMP TYPE RECOGNITION SCHEME

[75] Inventors: Demetri J. Giannopoulos, Norwalk, Conn.; Shenghong Wang, Yorktown Heights, N.Y.

[73] Assignee: Philips Electronics North America Corporation, New York, N.Y.

[21] Appl. No.: 09/124,428

[22] Filed: Jul. 29, 1998

[51] Int. Cl.[7] ..... H05B 37/02

[52] U.S. Cl. ..... 315/307; 315/308; 315/DIG. 5

[58] Field of Search ..... 315/94, 101, 102, 315/105, 106, 107, 50, 51, 71, 307, 308, 224, DIG. 5

[56] References Cited

U.S. PATENT DOCUMENTS 5,039,921 8/1991 Kakitani ..... 315/307
5,212,428 5/1993 Sasaki et al. ..... 315/308

FOREIGN PATENT DOCUMENTS

0338109B1 10/1989 European Pat. Off. .
0702508A1 3/1996 European Pat. Off. .

OTHER PUBLICATIONS

"An integrated ditigal control for electronic lighting", WESCON/97, Conference Proceedings (Cat. No. 97CH36148), Santa Clara, CA, USA Nov. 4–6 1997, Abstract.

*Primary Examiner*—David H. Vu
*Attorney, Agent, or Firm*—Bernard Franzblau

[57] ABSTRACT

A ballast for operating different types of lamp loads through identification of the lamp type during steady state operation of the lamp load. Lamp type recognition is achieved based on a comparison of the lamp load voltage and lamp load current data points stored in a random-access memory of a microprocessor to a plurality of V-I characteristic curves stored in a read-only memory of the microprocessor. Through this comparison, the ballast can distinguish among a number of different lamp loads having the same starting voltage.

14 Claims, 3 Drawing Sheets

FOR IMPROVEMENTS IN A LAMP TYPE RECOGNITION SCHEME

BACKGROUND OF THE INVENTION

This invention relates generally to an electronic ballast and, more particularly, to a scheme for identifying the type of fluorescent lamp which is being powered by the electronic ballast.

There are many different types of fluorescent lamps including preheat and rapid start. Not only do each of these lamp types have different ratings for ignition and/or steady state operation, but within each lamp type there are different ratings for ignition and/or steady state operation. These differences can be expressed, in part, by voltage-current (V-I) characteristic curves. A ballast inverter should be driven based on the V-I characteristic curve of the lamp.

A typical ballast is designed to supply a specific starting voltage and load current based on the V-I characteristic curve of the lamp to be powered by the ballast. Different ballasts are therefore required based on the lamp load to be powered. No one ballast can be used for all these different types of lamps. With the increasing number of lamps available, more and more different types of ballasts are required. Many of these lamps are produced in relatively small numbers, making the manufacturing cost for the associated ballast relatively high. Ballasts designs are further complicated by the number of different ballasts designs required.

One approach which has been proposed in attempting to solve the foregoing problems, as disclosed in U.S. Pat. No. 5,039,921, identifies the lamp to be powered based on the lamp's starting voltage. Three different types of V-I characteristic curves are stored in and can be accessed from a memory based on the lamp's starting voltage. The accessed V-I characteristic curve is used in driving the ballast inverter. Unfortunately, many lamps have the same or about the same starting voltage and therefore cannot be distinguished from each other based on the starting voltage. The starting voltage also changes during the lifetime of the lamp thereby complicating recognition of the lamp based on starting voltage.

It is therefore desirable to provide an improved electronic ballast which can power a number of different types of lamp loads. The improved ballast should be able to distinguish among a number of different lamp loads having the same starting voltage.

SUMMARY OF THE INVENTION

In accordance with a first aspect of the invention, a method for operating a ballast includes the steps of providing a sufficient starting voltage for ignition of a lamp load, adjusting the lamp load current to at least two different levels, measuring the lamp load voltage corresponding to each of the at least two different lamp load current levels, comparing the lamp load current and associated lamp load voltage for each of these at least two different levels to a plurality of lamp V-I characteristic curves, selecting the curve which best matches these at least two different levels, and operating the ballast based on the selected curve.

The ballast can power a number of different types of lamp loads through identification of the lamp type during steady state operation of the lamp load. Lamp type recognition is achieved based on a comparison of the lamp voltage and lamp current to a plurality of V-I characteristic curves. Through this comparison, the ballast can distinguish among a number of different lamp loads having the same starting voltage.

It is a feature of the invention that the method further include storing the lamp load current and associated lamp load voltage for each of these at least two different levels and plurality of lamp V-I characteristic curves in a microprocessor. In another feature of the invention, the method further includes producing switching signals to an inverter from a driver based on a signal outputted from the microprocessor. Preferably, the at least two different levels of lamp load current are substantially less than the nominal current rating of the lamp load.

In accordance with a second aspect of the invention, a ballast includes an inverter responsive to switching signals for powering one of at least two different lamp loads wherein each lamp load has a different V-I characteristic curve. The ballast also includes a microprocessor and a driver responsive to the microprocessor output signal for generating the switching signals. The microprocessor adjusts the current flowing through the lamp load to at least two different levels following ignition of the lamp load, measures the lamp load voltage corresponding to each of the at least two different lamp load current levels and compares the lamp load current and associated lamp load voltage for each of these at least two different levels to a plurality of lamp V-I characteristic curves. The microprocessor produces the microprocessor output signal based on the curve which best matches these at least two different levels.

Still other objects and advantages of the invention will, in part, be obvious and will, in part, be apparent from the specification.

The invention accordingly comprises several steps in and the relation of one or more such steps with respect to each of the others, and a device embodying features of construction, combination of elements, and arrangements of parts which are adapted to effect such steps, all is exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENT

Figure 1:
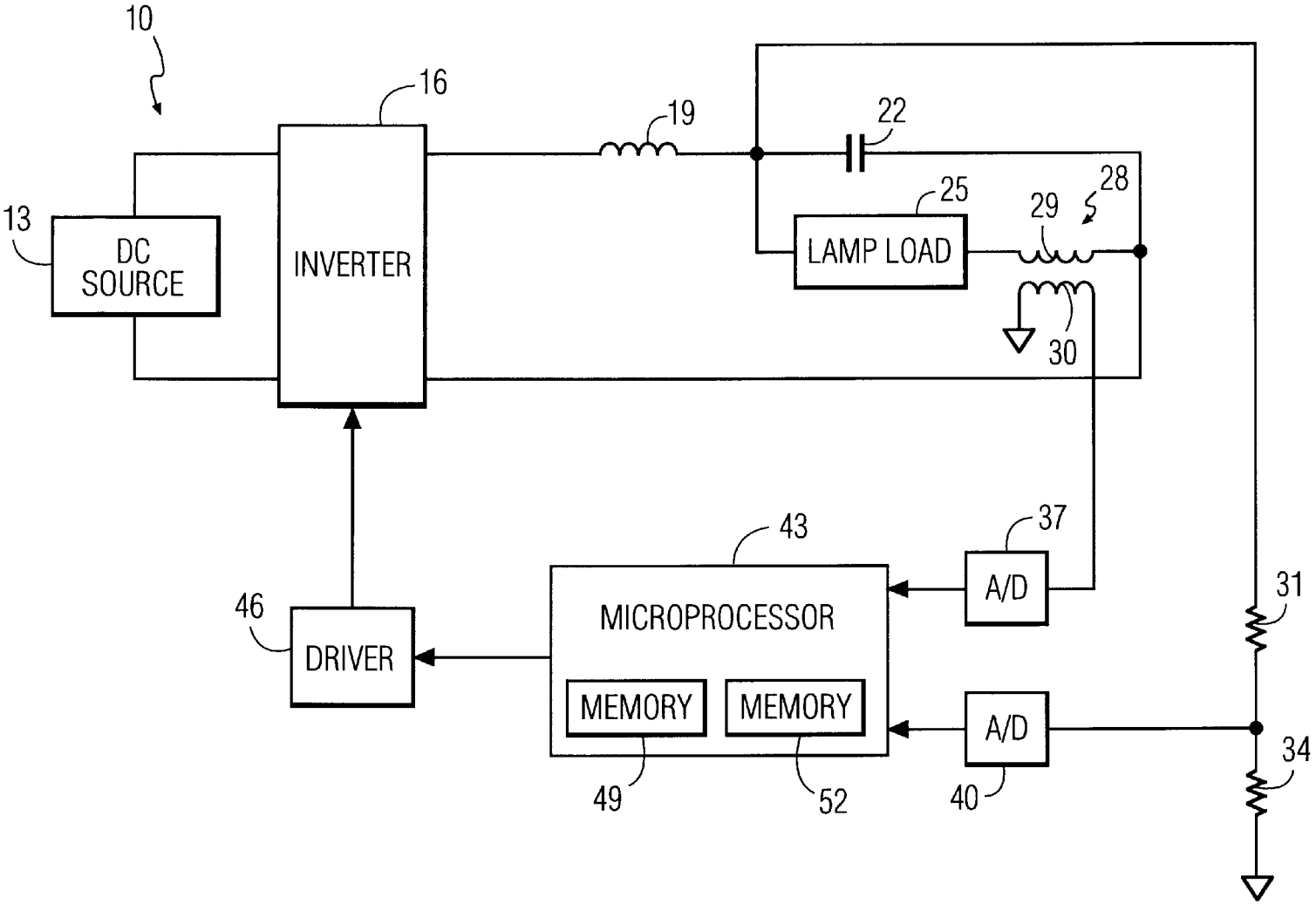
FIG. 1 is a partial block diagram and partical electrical schematic in accordance with the invention.

As shown in FIG. 1, a ballast 10 includes a DC source 13 which supplies a substantially DC voltage or current to an inverter 16, the latter of which can be of the full bridge or half bridge type. A high frequency pulse train, which can vary in frequency and/or pulse width, is supplied to a series resonant LC circuit which includes an inductor 19 and a capacitor 22. A serial combination of a lamp load 25 and a primary winding 29 of a current transformer 28 is connected in parallel across capacitor 22. The series resonant LC circuit filters the pulse train so as to apply a substantially high frequency sinsusoidal waveform to lamp load 25.

A voltage divider formed from a serial combination of a pair of resistors 31 and 34 is connected between ground and a junction joining inductor 19 to capacitor 22. The current flowing through lamp 25 (i.e. ILAMP) is sensed by a secondary winding 30 of transformer 28 and applied to an analog to digital converter (A/D) 37. The voltage across the serial combination of lamp load 25 and primary winding 29, which is essentially the voltage across lamp load 25 (i.e. VLAMP), is sensed by the voltage divider and applied to an analog to digital converter (A/D) 40. A pair of digital signals representing ILAMP and VLAMP are supplied by converters 37 and 40, respectively, to a microprocessor 43.

Microprocessor 43 outputs a signal to a driver 46, the latter of which in response to the microprocessor output signal controls the frequency and/or pulse width of the switching signals supplied to inverter 16. These switching signals determine the frequency and/or pulse width of the pulse train outputted by inverter 16. During steady state operation of lamp load 25, the microprocessor output signal reflects the V-I characteristic curve of lamp load 25.

Figure 2:
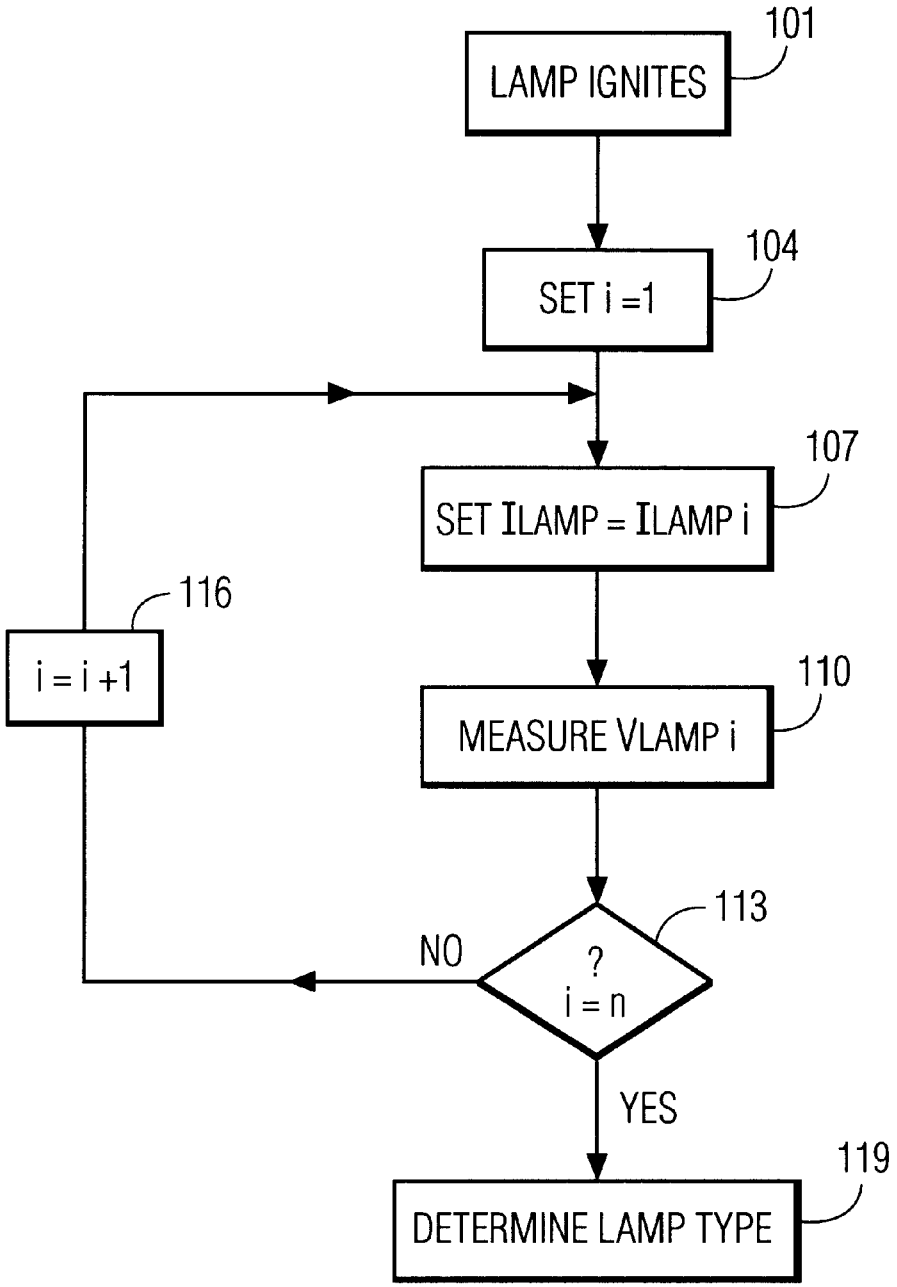
FIG. 2 is a flow chart of a lamp recognition scheme.

The V-I characteristic curve chosen by microprocessor 43 is based on a sequence of steps as shown in FIG. 2. Under a step 101, lamp load 25 first passes through ignition. Once lamp load 25 is in its steady state mode of operation, under a step 104 microprocessor 43 sets the value of i=1. Under a step 107, the microprocessor output signal now reflects setting the value of ILAMP=ILAMPi. The switching signals produced by driver 46, which are supplied to inverter 16 in response to the microprocessor output signal result in ILAMP=ILAMPi. Under a step 110, the value of VLAMPi is now measured by microprocessor 43 based on the signal produced by A/D converter 40. The values of VLAMPi and ILAMPi are temporarily stored in a random access memory 49. The value of i is checked under step 113 to determine if i=n, where n is equal to at least 2. In the event that i is not yet equal to n, the value of i is incremented by a value of 1 under step 116. Steps 107 through 116 are repeated until under step 113 i=n. The lamp type is then determined by microprocessor 43 under step 119. Assuming n=3, three different sets of VLAMP and ILAMP values stored in memory 49 are compared to the plurality of V-I characteristic curves stored in a read-only memory 52. The V-I characteristic curve which best matches the values of VLAMPi and ILAMPi is chosen by microprocessor 43 and used in producing the microprocessor output signal.

Figure 3:
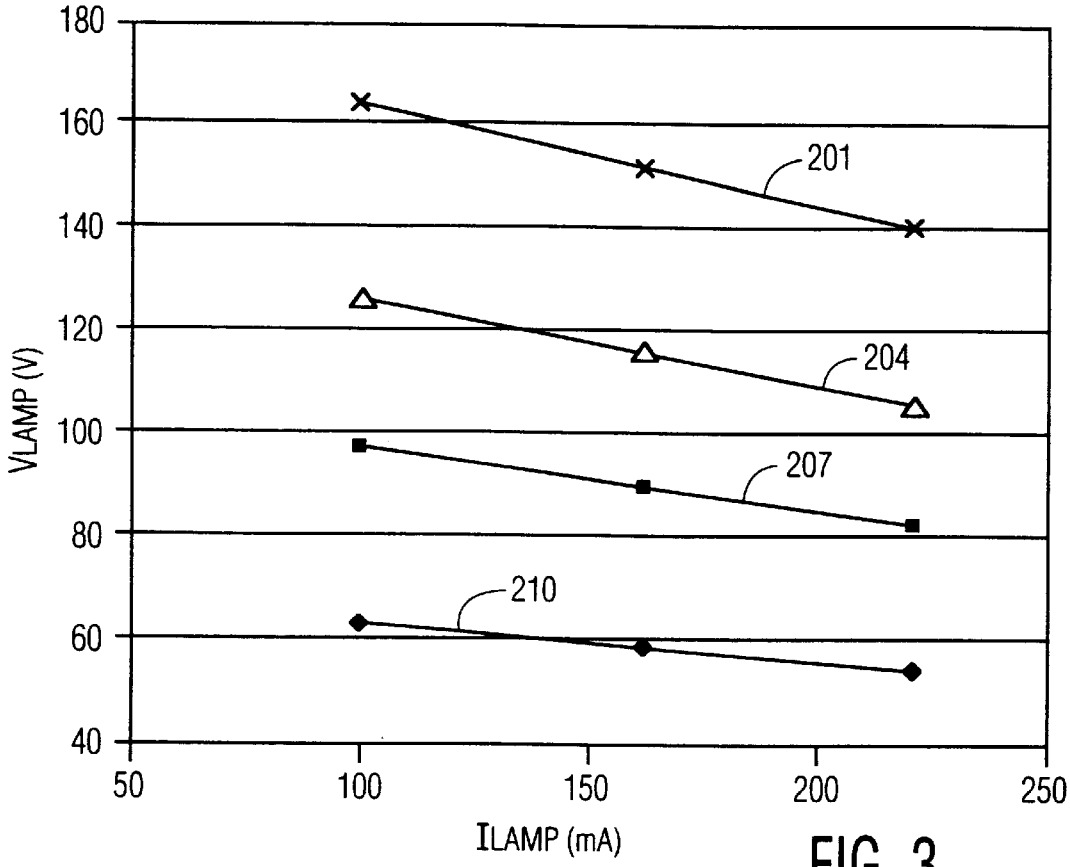
FIG. 3 is a plot illustrating several V-I characteristics curves.

A sample of the V-I characteristic curves stored in memory 52 is illustrated in FIG. 3. Four V-I characteristic curves 201, 204, 207 and 210 represent nominally rated 40 watt, 36 watt, 24 watt and 18 watt fluorescent lamps, respectively. The curves stored in memory 52 should include curves for all of the different types of lamps which ballast 10 could be expected to power. The value of n should be chosen so that there are a sufficient number of VLAMPi and associated ILAMPi values from which to choose among the plurality of curves stored in memory 52. In other words, the value of n can be, if required, greater than n=2. All values of ILAMPi set by microprocessor 43 are less than the nominal current rating of lamp load 25 (i.e. current rating of lamp load 25 at full illumination) in order to protect the latter from damage. Preferably, ILAMPi+1 is greater than ILAMPi such that ILAMPn is the highest value of ILAMP set by microprocessor 43. In one preferred embodiment of the invention when n=3, ILAMP1, ILAMP2 and ILAMP 3 are chosen so as to be equal to 25%, 35% and 45% of the nominal current rating for lamp load 25, respectively.

Figure 4A:
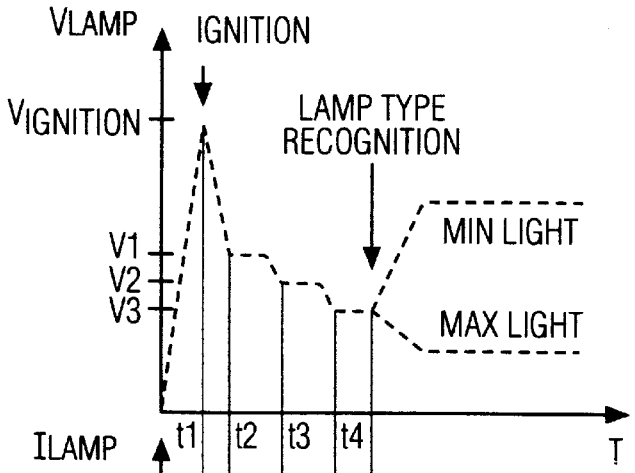
FIGS. 4A and 4B are plots of the lamp voltage and lamp current versus time, respectively.
Figure 4B:
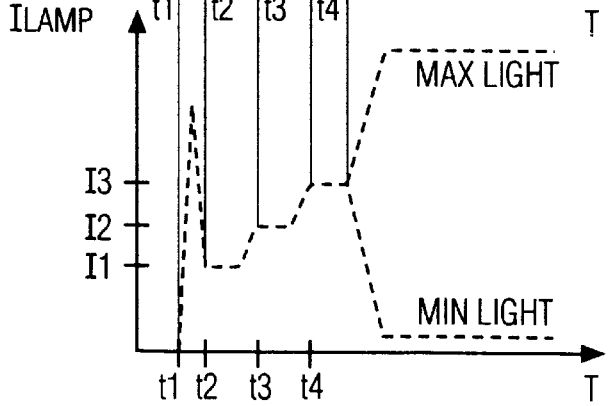

Referring now to FIGS. 4A and 4B, the values of VLAMP (FIG. 4A) and ILAMP (FIG.4B) are plotted for n=3. As shown in FIG. 4A, the voltage across lamp load 25 is raised until lamp load 25 ignites at time t1. Following ignition, the voltage across lamp load 25 decreases and the level of current flowing in lamp load 25 increases. Lamp load 25 is now in its steady state of operation. At time t2, microprocessor 43 has set ILAMPi to a value of I1. The value of VLAMP (i.e. V1) is determined by microprocessor 43 based on the signal produced by A/D 40 and stored within memory 49. Microprocessor 43 at time t3 has set ILAMPi to a value of I2, determines the value of VLAMP (i.e. V2) and stores the latter in memory 49. Microprocessor 43 at time t4 has set ILAMPi to a value of I3, determines the value of VLAMP (i.e. V3) and stores the latter in memory 49. The three different sets of VLAMP and ILAMP values stored in memory 49 are now compared to the plurality of V-I characteristic curves stored in memory 52. The V-I characteristic curve which best matches the values of VLAMPi and ILAMPi is chosen by microprocessor 43 and used in producing the microprocessor output signal.

The level of lamp current I3 is substantially less than the current level at full illumination (i.e. denoted as "max light") for lamp load 25. Operation of lamp load 25 in regions near or above its nominal rating is thereby avoided. Once lamp load 25 has been identified, microprocessor 43 adjusts the lamp current to a desired level as determined by the user. For example, when ballast 10 is used in combination with a dimmer (not shown), microprocessor 43 will control the level of lamp load illumination to the level set by the dimmer including, if desired, to the lowest level of illumination possible.(denoted as "min light").

As can now be readily appreciated, ballast 10 can power a number of different types of lamp loads through identification of the lamp type during steady state operation of lamp load 25. Lamp type recognition is achieved based on a comparison of the lamp voltage and lamp current data points stored in memory 49 to the plurality of V-I characteristic curves stored in memory 52. Through this comparison, ballast 10 can distinguish among a number of different lamp loads having the same starting voltage.

It will thus be seen that the objects set forth above and those made apparent from the preceding description are efficiently attained and since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What we claim is:

1. A method for operating a ballast comprising the steps of:

providing a sufficient starting voltage for ignition of a lamp load;

adjusting the lamp load current to at least two different levels;

measuring the lamp load voltage corresponding to each of the at least two different lamp load current levels;

comparing the lamp load current and associated lamp load voltage for each of these at least two different lamp load current levels to a plurality of lamp V-I characteristic curves;

selecting the curve which best matches these at least two different levels; and operating the ballast based on the selected curve.

2. The method of claim 1, further including storing the lamp load current and associated lamp load voltage for each of these at least two different levels and the plurality of lamp V-I characteristic curves in a microprocessor.

3. The method of claim 2, further including producing switching signals to an inverter from a driver based on a signal outputted from the microprocessor.

4. The method of claim 1, wherein the at least two different levels of lamp load current are substantially less than the nominal current rating of the lamp load.

5. The method of claim 3, wherein the at least two different levels of lamp load current are substantially less than the nominal current rating of the lamp load.

6. The ballast operating method of claim 1 wherein the step of adjusting the lamp load current to at least two different current levels occurs after the lamp reaches a condition of equilibrium in which the light output of the lamp is stable.

7. A ballast, comprising:

an inverter responsive to switching signals for powering one of at least two different lamp loads, each lamp load having a different V-I characteristic curve;

a driver responsive to a microprocessor output signal for generating the switching signals; and;

a microprocessor for adjusting the current flowing through the lamp load to at least two different levels following ignition of the lamp load, measuring the lamp load voltage corresponding to each of the at least two different lamp load current levels, comparing the lamp load current and associated lamp load voltage for each of these at least two different levels to a plurality of lamp V-I characteristic curves and selecting the curve which best matches these at least two different levels and producing the microprocessor output signal based on the selected curve.

8. The ballast as claimed in claim 7 wherein the microprocessor comprises;

first means for digitally storing said plurality of lamp V-I characteristic curves, second means for digitally storing said at least two adjusted different levels of lamp load current and respective values of lamp load voltage corresponding to each of said two adjusted different levels of lamp load current, and means for comparing the two stored values of lamp load current and corresponding respective values of lamp load voltage with the stored plurality of lamp V-I characteristic curves and selecting the V-I characteristic curve which best matches said at least two different levels.

9. The ballast as claimed in claim 8 further comprising;

means for detecting the value of the lamp load voltage at each of the two adjusted different levels of lamp load current, means for deriving signals determined by the two adjusted different levels of lamp load current, first and second analog/digital converters responsive respectively to signals from said detecting means and said deriving means, and said second digital storing means of the microprocessor includes a random access memory for storing digital signals supplied by said first and second analog/digital converters.

10. The ballast as claimed in claim 9 wherein the first digital storing means comprises a read only memory.

11. The ballast as claimed in claim 7 wherein the lamp load comprises a series resonant circuit including an inductor and a capacitor and with lamp connection terminals connected across the capacitor.

12. The ballast as claimed in claim 7 wherein the at least two different levels of lamp load current are substantially less than the nominal current rating of the at least two different lamp loads.

13. The ballast as claimed in claim 7 wherein the plurality of lamp V-I characteristic curves are stored in a read only memory and the two different levels of lamp load current and the two different values of lamp load voltage corresponding thereto are stored in a random access memory.

14. The ballast as claimed in claim 7 wherein the microprocessor adjusts the lamp load current to said at least two different levels after the lamp reaches a condition of equilibrium in which the light output of the lamp is stable.

* * * * *